United States Patent [19]

Schuster

[11] Patent Number: 5,053,057

[45] Date of Patent: Oct. 1, 1991

[54] FIRELIGHTING FLUID CONSISTING OF ALCOHOL, WATER AND THICKENING AGENT

[75] Inventor: Wilhelm Schuster, Frankfurt am Main, Fed. Rep. of Germany

[73] Assignee: AHK Alkohol Handelskontor GmbH & Co. KG, Frankfurt, Fed. Rep. of Germany

[21] Appl. No.: 188,776

[22] Filed: May 22, 1986

[30] Foreign Application Priority Data

May 25, 1985 [DE] Fed. Rep. of Germany ..... 3518921

[51] Int. Cl.[5] ..... C10L 1/18

[52] U.S. Cl. ..... 44/349; 44/443; 44/451

[58] Field of Search ..... 44/53, 55, 77, 56, 349, 44/443, 451

[56] References Cited

U.S. PATENT DOCUMENTS

| | | | |
|---|---|---|---|
| 7,667 | 9/1850 | Howe | 44/55 |
| 1,019,746 | 3/1912 | Appel | 44/55 |
| 1,895,032 | 1/1933 | Fisher | 44/53 |
| 2,012,945 | 9/1935 | Berliner | 44/55 |
| 3,964,380 | 6/1976 | Siegrist | 44/70 |
| 4,129,421 | 12/1978 | Webb | 44/56 |
| 4,231,756 | 11/1980 | King | 44/56 |
| 4,242,098 | 12/1980 | Braun | 44/90 |
| 4,255,158 | 3/1981 | King | 44/56 |
| 4,599,088 | 7/1986 | Davis | 44/56 |

FOREIGN PATENT DOCUMENTS

| | | | |
|---|---|---|---|
| 3518921 | of 1986 | Fed. Rep. of Germany . | |
| 0116791 | 9/1981 | Japan | 44/55 |
| 0124994 | 7/1984 | Japan | 44/55 |

*Primary Examiner*—Prince E. Willis
*Assistant Examiner*—Jerry D. Johnson
*Attorney, Agent, or Firm*—Fidelman & Wolffe

[57] ABSTRACT

A firelighting fluid for igniting coal and wood, consisting of an alcohol stabilized by the addition of water and at least one alcohol-soluble thickening agent, is described.

5 Claims, No Drawings

FIRELIGHTING FLUID CONSISTING OF ALCOHOL, WATER AND THICKENING AGENT

The invention relates to a firelighting fluid for igniting coal and wood.

Firelighters for coal and wood for a grill or fireplace exist in a variety of forms, for example as firelighting pastes made of denatured alcohol and colloidal silicic acid, as fibrous plates impregnated with wax, as petroleum-based firelighting oil or as denatured alcohol. All these materials, however, have disadvantages. Thus, firelighting pastes and impregnated fibrous plates in fragment form are, owing to their consistency, localized on certain areas, with the result that only adjacent particles of coal and wood ignite. Moreover, these more or less solid firelighters never burn without leaving a residue, and undesirable decomposition products can result. The same also holds for firelighting oils. It is true that denatured alcohol as firelighter wets the pieces of coal and wood, but it evaporates and burns too quickly for adequate ignition to have developed, and, besides, there is the danger of deflagration and sputtering.

The object of the invention is to develop a liquid firelighter for coal and wood which produces a lasting wetting action over a large area and, by a sufficiently slow combustion, guarantees certain ignition of the coal and wood pieces.

This object is achieved by a firelighting fluid for igniting coal and wood, which consists of an alcohol stabilized by the addition of water and at least one alcohol-soluble thickening agent.

Appropriate preparations of the firelighting fluid are given in the subclaims.

In comparison with the customary firelighters, a firelighting fluid stabilized in this manner offers considerable advantages. A certain degree of stabilization is achieved by the addition of water and the combustion of the alcohol is slowed down. The addition of a thickening agent thickens the firelighting fluid, with the result that sputtering—i.e. rapid dispersion—on the coal and wood pieces to be ignited as well as on the substrate thereof, and the spontaneous evaporation and burning occuring with pure alcohol, are avoided. This addition also has a stabilizing action and, additionally, produces economies in the use of the firelighting fluid. Virtually any amount of grill coal can be reliably ignited with 40 to 50 ml of the stabilized firelighting fluid and made to glow. The firelighting fluid is appropriately produced from materials designated as being of high purity, so that it can be assumed that no physiologically harmful decomposition products are formed in the combustion which would be disadvantageous as regards ordor, flavor and/or health. The elimination of these secondary phenomena is essential especially for use as grill lighters. The firelighting fluid stabilized according to the invention burns virtually free from any residues. By the use of the thickening agent the viscosity of the firelighting fluid can be adjusted as required. The fluid should at any rate be sufficiently liquid in order to disperse on the coal and wood fragments to be ignited and wet them essentially uniformly. This ensures that the firelighting fluid between the coal and wood particles burns relatively slowly and that these are ignited. The water evaporating in the combustion brings about a constant cooling of the burning liquid which consequently evaporates and hence burns more slowly. It was observed that the stabilized firelighting fluid burns with smaller flames than pure alcohol. The viscosity of preferred preparations is chosen so that the said preparations can be dispensed through the nozzles of bottles which have flexible, compressible sides and are provided with special closures, for example safety closures. In this manner the amount dispensed can be readily controlled by the user.

It was found that isopropanol is very particularly suitable as a stabilized fuel. Its fuel value with 15% by volume of water added corresponds to that of commercial denatured alcohol. Hydroxypropylcellulose and polyethylene oxide are suitable for use as thickening agents possessing the desired properties, i.e. extensive or completely residue-free combustion and avoidance of undesirable, disadvantageous decomposition products.

The tests given below illustrate the advantageous results achieved with stabilized alcohol, in particular isopropanol.

| Grill lighting tests<br>Charcoal (30 g in heaps) | |
|---|---|
| Denatured alcohol alone | Isopropanol + 10% of $H_2O$ + 0.50% of hydroxypropylcellulose (300 cps) |
| Amount applied 10 g | Amount applied 10 g |
| Combustion time 4 minutes | Combustion time 6 minutes |
| Height of flame 23 cm | Height of flame 12 cm |
| Coal glows only on edges | Coal glows on the edges and in the center of the pile |
| After 8 minutes the ember glow is extinguished | After 15 minutes the embers still glow |

Deflagration tests on a glowing pile of flameless charcoal; 10 g of fluid is applied in each case and ignited after 5 seconds with a match.

| | | |
|---|---|---|
| Denatured alcohol alone | Strong deflagration | Height of flame 45–50 cm |
| Denatured alcohol + 0.50% of hydroxypropylcellulose (300 cps) | Weak deflagration | Height of flame 32–35 cm |
| Isopropanol + 10% of $H_2O$ + 0.50% of hydroxypropylcellulose (300 cps) | Weak deflagration | Height of flame 25–30 cm |

COMBUSTION TESTS WITH STABILIZED FIRELIGHTING FLUID ON A TIN PLATE SUBSTRATE

| | Amount (g) | Wetted area ($cm^2$) | Combustion time (s) | Height of flame (cm) |
|---|---|---|---|---|
| Denatured alcohol alone | 2 | 85 | 27 | 35–38 |
| Denatured alcohol + 0.50% of hydroxypropylcellulose | 2 | 30 | 60 | 30–33 |
| Isopropanol alone | 2 | 95 | 28 | 38–45 |
| Isopropanol + 15% of $H_2O$ | 2 | 77 | 30 | 35–40 |
| Isopropanol + 5% of $H_2O$ + 0.50% of hydroxypropylcellulose | 2 | 24 | 70 | 25–30 |
| Isopropanol + 10% of $H_2O$ + 0.30% of hydroxypropyl- | 2 | 32 | 58 | 30–35 |

-continued

| | Amount (g) | Wetted area ($cm^2$) | Combustion time (s) | Height of flame (cm) |
|---|---|---|---|---|
| cellulose | | | | |
| Isopropanol + 10% of $H_2O$ + 0.40% of hydroxypropyl-cellulose | 2 | 24 | 70 | 25–28 |
| Isopropanol + 10% of $H_2O$ + 0.50% of hydroxypropyl-cellulose | 2 | 24 | 70 | 19–23 |
| Isopropanol + 15% of $H_2O$ + 0.40% of hydroxypropyl-cellulose | 2 | 17.34 | 76 | 18–22 |
| Isopropanol + 20% of $H_2O$ + 0.40% of hydroxypropyl-cellulose | 2 | 18.85 | 67 | 20–25 |
| Isopropanol + 30% of $H_2O$ + 0.40% of hydroxypropyl-cellulose | 2 | 18.09 | 62 | 20–24 |
| Isopropanol + 15% of $H_2O$ + 0.40% of polyethylene oxide type WSR 302 | 2 | 35.25 | 58 | 26–30 |
| Isopropanol + 15% of $H_2O$ + 0.20% of hydroxypropyl-cellulose and 0.20% of polyethylene | 2 | 22.6 | 70 | 23–28 |

-continued

| | Amount (g) | Wetted area ($cm^2$) | Combustion time (s) | Height of flame (cm) |
|---|---|---|---|---|
| oxide type WSR 302 | | | | |

The tests demonstrate that even stabilized denatured alcohol spreads to a smaller extent and burns twice as long as denatured alcohol alone.

Excellent results are achieved with isopropanol, optimum results being observed with a 10 to 15% addition of water and 0.40 to 0.50% addition of hydroxypropylcellulose. A mixture of hydroxypropylcellulose and polyethylene oxide also furnishes very good values.

I claim:

1. A firelighting liquid for igniting coal or wood, consisting of an alcohol stabilized by the addition of water and at least one alcohol-soluble thickening agent, wherein said liquid contains 10 to 30% by volume of water and 0.3 to 6% by weight of the thickening agent, said at least one thickening agent selected from the group consisting of hydroxypropylcellulose, non-ionic polyethylene oxide and mixtures thereof.

2. A firelighting liquid as claimed in claim 1, wherein the thickening agent is added in an amount of from 0.4 to 0.5% by weight.

3. A firelighting liquid as claimed in claim 1, wherein the alcohol is isopropanol.

4. A firelighting liquid as claimed in claim 1, wherein the thickening agent is hyroxypropylcellulose.

5. A firelighting liquid as claimed in claim 1, wherein the thickening agent is a mixture of hydroxypropylcellulose and non-ionic polyethylene oxide.

* * * * *